US005634713A

United States Patent [19]

Abe

[11] Patent Number: 5,634,713

[45] Date of Patent: Jun. 3, 1997

[54] PNEUMATIC MATERIAL TRANSPORTER AND MIXER

[75] Inventor: Kiyoyuki Abe, Hokkaido, Japan

[73] Assignee: Endo Co., Ltd., Hokkaido, Japan

[21] Appl. No.: 512,482

[22] Filed: Aug. 14, 1995

[30] Foreign Application Priority Data

Dec. 5, 1994 [JP] Japan ..... 6-330075

[51] Int. Cl.[6] ..... B01F 13/02

[52] U.S. Cl. ..... 366/102; 366/13; 366/107; 366/152.6; 366/154.1; 366/156.1; 366/172.1; 366/181.1; 366/191; 406/11; 406/25; 406/32; 406/56; 406/60; 406/61; 406/93; 406/95; 406/125; 406/137; 406/144; 406/146

[58] Field of Search ..... 366/10, 13, 34, 366/35, 38, 42, 102, 107, 156.1, 158.1, 168.1, 172.1, 181.1, 182.3, 183.1, 191, 152.6, 194–196, 154.1; 406/10, 11, 12, 19, 24, 25, 32, 47, 48, 53, 56, 60, 61, 93, 94, 95, 108, 122, 124–126, 136, 137, 144, 146

[56] References Cited

U.S. PATENT DOCUMENTS

| | | | |
|---|---|---|---|
| 1,423,853 | 7/1922 | Hodgson | 366/13 |
| 2,621,083 | 12/1952 | Daniels | 406/61 |
| 4,064,829 | 12/1977 | Hervert | 366/107 X |
| 4,138,162 | 2/1979 | Noren | 406/61 |
| 4,801,210 | 1/1989 | Gian | 406/61 X |

FOREIGN PATENT DOCUMENTS

| | | | |
|---|---|---|---|
| 551485 | 4/1923 | France | 366/13 |
| 1158931 | 12/1963 | Germany | 406/47 |
| 56-7832 | 1/1981 | Japan | 406/61 |
| 2147397 | 5/1985 | United Kingdom | 406/61 |

*Primary Examiner*—Charles E. Cooley
*Attorney, Agent, or Firm*—Goodman & Teitelbaum, Esq.

[57] ABSTRACT

A pneumatic material transporter includes a material hopper (2), a screw conveyor (3) to transport the material (supplied from the hopper) from the rear portion to a front portion of the screw conveyor, a pressure chamber portion (5) to receive the materials from the screw conveyor and to press the materials down while adding a limited amount of water, a horizontal mixer (6) adapted to mix the material supplied from the pressure chamber portion with pressurized air, and then push the mixture to a material transporting conduit portion (8) connected to the mixer through a check valve portion, so that the material transporting conduit portion transports the materials to a yard.

18 Claims, 15 Drawing Sheets

PNEUMATIC MATERIAL TRANSPORTER AND MIXER

BACKGROUND OF THE INVENTION

The present invention relates to a pneumatic material transporter and, in particular, to a pneumatic material transporter which is suitable for transporting materials such as sand, gravel, volcanic ashes, sludge, etc., putting these under air pressure at a site under construction.

It has been a traditional way to transport solid materials such as sand, gravel or the like by dump trucks, carrier dumpers and belt-conveyors etc., at a site under construction. Transporting by these means, however, provides the latent sources of air pollution, noise pollution and traffic problems.

In another conventional technique, a hydraulic transporting machine which is free from such problems is commonly used. Materials are sent through a conduit powered by hydraulic pressure. In such hydraulic transporter, however, materials must be fluidized by adding water. Fluidization of solid materials are performed by drawing solid materials into a pressure tank and by adding water to the solid materials and stirring them to get sludge materials. The sludge material is transported through the conduit connected to the pressure tank by pressurizing the latter.

In a conventional hydraulic transporter, it is necessary to employ the pressure tank which is large and expensive. Therefore, in case of using the hydraulic transporter it is also necessary that it be installed on a firm foundation and be reinforced. In some case, it is necessary to construct a temporary road, etc., therefore, the construction costs too much. Further, it is inevitable to install such hydraulic transporter in a large area. Further, since a large amount of water is contained in the equipment it is not easy to handle the equipment and dispose of the materials after transporting.

SUMMARY OF THE INVENTION

An object of the present invention is to provide a novel pneumatic transporter which is free from the problems of the conventional hydraulic transporter.

In order to achieve the above object, a pneumatic material transporter (1) according to the present invention, comprises a material supply hopper (2), a screw conveyor (3) connected to the material supply hopper, a pressure chamber (5) connected to a lower surface of a front end portion of the screw conveyor through a material supply port (4), a horizontal mixer portion (6) connected to a lower end of the pressure chamber, a transporting conduit portion (8) connected to a front end of the mixer portion through a check valve portion (7) and a compressed air supply pipe (9) connected to a rear end of the mixer portion. Material (19) such as sand, gravel, etc., supplied to the supply hopper is supplied by the screw conveyor to the pressure chamber in which it is stirred with a small amount of water and transferred down to the mixer portion under pressure. In the mixer portion, pressurized air is supplied into the material. Then, the material is transported by pressurized air through the pressure conduit to a yard.

In a first aspect of the present invention, a pneumatic material transporter (1) comprises a material supply hopper (2) equipped with a screen, a screw conveyor (3) connected to a lower surface of the supply hopper and extending horizontally, a pressure chamber (5) connected to a lower surface of a top end portion of the screw conveyor through a material supply port (4) and the pressure chamber having pressure means for pressing the material (19) therein down while adding a small amount of water, a horizontal mixer portion (6) connected to a lower end of the pressure chamber, a pressure conduit portion (8) connected to the front end of the mixer portion through a check valve portion (7) and a compressed air supply pipe (9) connected to a rear end of the mixer portion. The pneumatic material transporter further comprises an openable gate (4A) provided in a lower opening portion of the material supply port (4), an activator stirring tank (12), an activator injecting pipe (13) having one end connected to a lower opening of the activator stirring tank through an activator injecting pump (13A) and the other end connected to the front end portion of the screw conveyor, a water supply pipe (14) having one end connected to an upper portion of the activator stirring tank and the other end connected to a water supply pump (15B), a water supply tank (16) having an inlet connected to the water supply pump. The pressure chamber comprises a casing having an upper cylinder portion (5), a lower funnel portion and a pressure relief valve (5B) provided in a side wall of the upper cylinder portion. The pressure means comprises a pressurized air nozzle (5C) provided on a side wall of the upper cylinder portion and a water supply pipe (5D) provided on the side wall of the upper cylinder portion. The pressure chamber further comprises material sensor means (5E) provided on the side wall of the upper cylinder portion in a level below the pressurized air nozzle (5C) and the water supply pipe (5D) and an auxiliary pressurized air nozzle (5F) provided on the side wall of the funnel portion in a level below the material sensor means, and the pressurized air nozzle and the auxiliary pressurized air nozzle are connected to a primary pressurized air supply pipe (11). A front portion of the horizontal mixer (6) comprises a reducer (6B) formed on an inner wall thereof and a rear portion of the horizontal mixer comprises a rotatably supported stirring nozzle pipe (6C) having a rear end connected to a pressurized air supply pipe (9), through a geared motor (6F) and swivel (6G), and to the inlet of the water supply tank at a position the rear of the geared motor and swivel, a stirring nozzle (6D) provided in a front end face of the stirring nozzle pipe and a stirring fin (6E) provided in a peripheral surface of a front end portion of the stirring nozzle pipe. The stirring fin is positioned in an area facing towards the lower opening of the pressure chamber. The check valve portion (7) comprises a lateral pipe (7A) having a rear end connected to the front end portion of the horizontal mixer, a check valve (7B) provided in the lateral pipe and driven by a check valve cylinder (7B1) and a plurality of water supply nozzles (7C) provided between the front end portion of the horizontal mixer and the check valve for injecting water radially inwardly of said lateral pipe. The pressure transporting conduit portion (8) comprises a plurality of series connected pressure conduit units (8A) and one of the conduit units which is adjacent to the check valve portion is formed with a hole connected to an end of a pressurized air supply pipe (10A) extending obliquely therefrom with respect to the check valve portion and connected to a secondary pressurized air supply tube (10) for injecting pressurized air into the check valve portion in a direction substantially in parallel with an axis of the check valve portion. An inlet of the water injecting tank (16) is connected to the water supply pump (15B) and to a portion of the pressurized air supply pipe (9) positioned between the valve (9A) and the swivel (6G), and an output of the water injecting tank (16) is connected to the water supply pipe (5D) of the pressure chamber (5) and to the water injecting nozzle (7C) of the check valve portion through a water injecting distributor (16C).

In the pressure air transporter according to the first aspect of the present invention, the pneumatic material transporter further comprises at least one clog-preventing tube (17) between adjacent ones of the conduit units (8A). The clog-preventing tube comprises a rear portion (17C) including an inlet portion connected to an upstream one of the adjacent conduit units and an expanding portion, an intermediate portion (17A) having a rear end connected to the expanding portion and having an axis (17A1) registered with an axis (17C1) of the upstream conduit unit and a front portion (17B) having a rear end connected to the intermediate portion, a shrinking portion and a front end connected to the other conduit unit of the adjacent conduit units. The front end portion (17B) of the clog-preventing tube (17) has an axis (17B1) below the axis of the intermediate portion. The intermediate portion is formed in the vicinity of the rear portion (17C) thereof with a hole connected to an obliquely extending intermediate auxiliary nozzle (17D) connected to the secondary compressed air supply tube (10) for jetting pressurized air into the intermediate portion to assist a smooth transportation of the material.

The pneumatic material transporter claimed further comprises material push-up means (18) for pushing up the material in the conduit (8) to assist a smooth transportation of the material in the conduit. The material push-up means comprises a lateral pipe portion (18A) having one end connected to the secondary pressurized air supply tube (10) through a pipe (18C) and a valve (18C1). The lateral pipe portion is connected to a bottom of the conduit (8) through a plurality of pipes (18B) so that the material in the conduit (8) is pushed up by pressurized air supplied through the pipe (18B).

The material (19) is supplied to the material hopper (2) through the screen by a backhoe or shovel-dozer. The material is then supplied forcibly to the material supply port (4) by the screw conveyor (3). In supplying the material to the material supply port, an activator is supplied to the screw conveyor from the activator stirring tank (12) if necessary. The activator functions to prevent abrasion of the transporting conduit and to smoothen the transportation.

When the amount of the material in the pressure chamber reaches a predetermined level, the material sensors (5E) detect it to stop the screw conveyor and close the gate (4A). Simultaneously therewith, the check valve (7B) is opened to supply compressed air to the pressure chamber through the compressed air nozzle (5C) and the auxiliary nozzle (5F).

A small amount of water is jetted from the injecting nozzle (7C) into the pressure chamber to remove material adhered to the pressure chamber (5) and the transporting conduit (8) to thereby smoothen the pneumatic transportation of the material and prevent dust from scattering from an outlet of the conduit.

The material in the mixer (6) is stirred and pushed by the stirring nozzle (6D). When the material reaches the conduit (8), there is a backflow of compressed air necessarily. Therefore, when, the predetermined amount of material is completely transferred from the pressure chamber through the mixer to the conduit, the check valve (7B) is forcibly closed to prevent the backflow of compressed air.

When the material contains large blocks, it is transported through the conduit while the blocks are pushed up by the material push-up means.

When the check valve (7B) is closed, residual compressed air in the pressure chamber is discharged immediately through the relief valve (5B) and the gate (4A) is opened again and the screw conveyor (3) is activated again to allow the next supply of material to go to the pressure chamber.

These operations of the various constitutional components are controlled electrically to smoothen the operation of the pneumatic material transporter and then thereby smoothen the transportation of material. By repeating this operation cycle continuously, a large amount of material can be transported substantially.

The conduit may get clogged with the material transported from the pressure chamber to the conduit under pressure due to friction of the material with the conduit units thereof. This may occur immediately before the material moves from one conduit unit to the next conduit unit.

Therefore, it is preferable to arrange the clog-preventing tube immediately before a transition portion from one conduit unit to the next.

The clog-preventing tube has a diameter which is at least twice the size of the conduit unit to reduce friction of the material temporarily.

With such temporary reduction of friction, abrasion of the transition portion and subsequent friction is reduced, as a result a smooth transportation of the material is going on.

When the transporting conduit is long, the intermediate auxiliary nozzle must be provided in the clog-preventing tube for jetting compressed air thereinto to restore the pressure lowered by the friction.

DETAILED DESCRIPTION OF THE PREFERRED EMBODIMENTS

A first embodiment of the present invention will now be described with reference to FIGS. 1 to 12.

Figure 1:
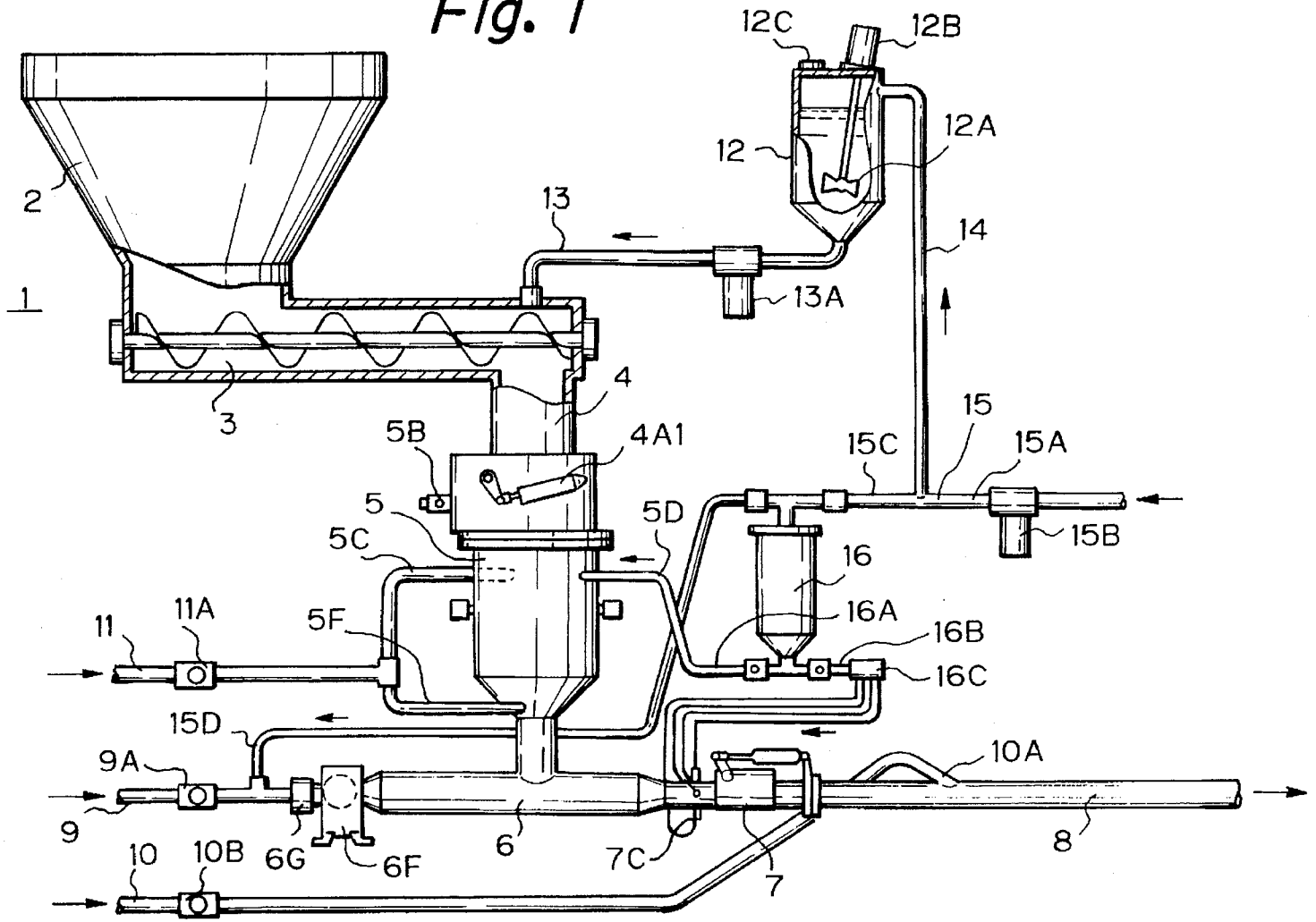
FIG. 1 shows a construction of a pneumatic material transporter according to a first embodiment of the present invention.
Figure 2:
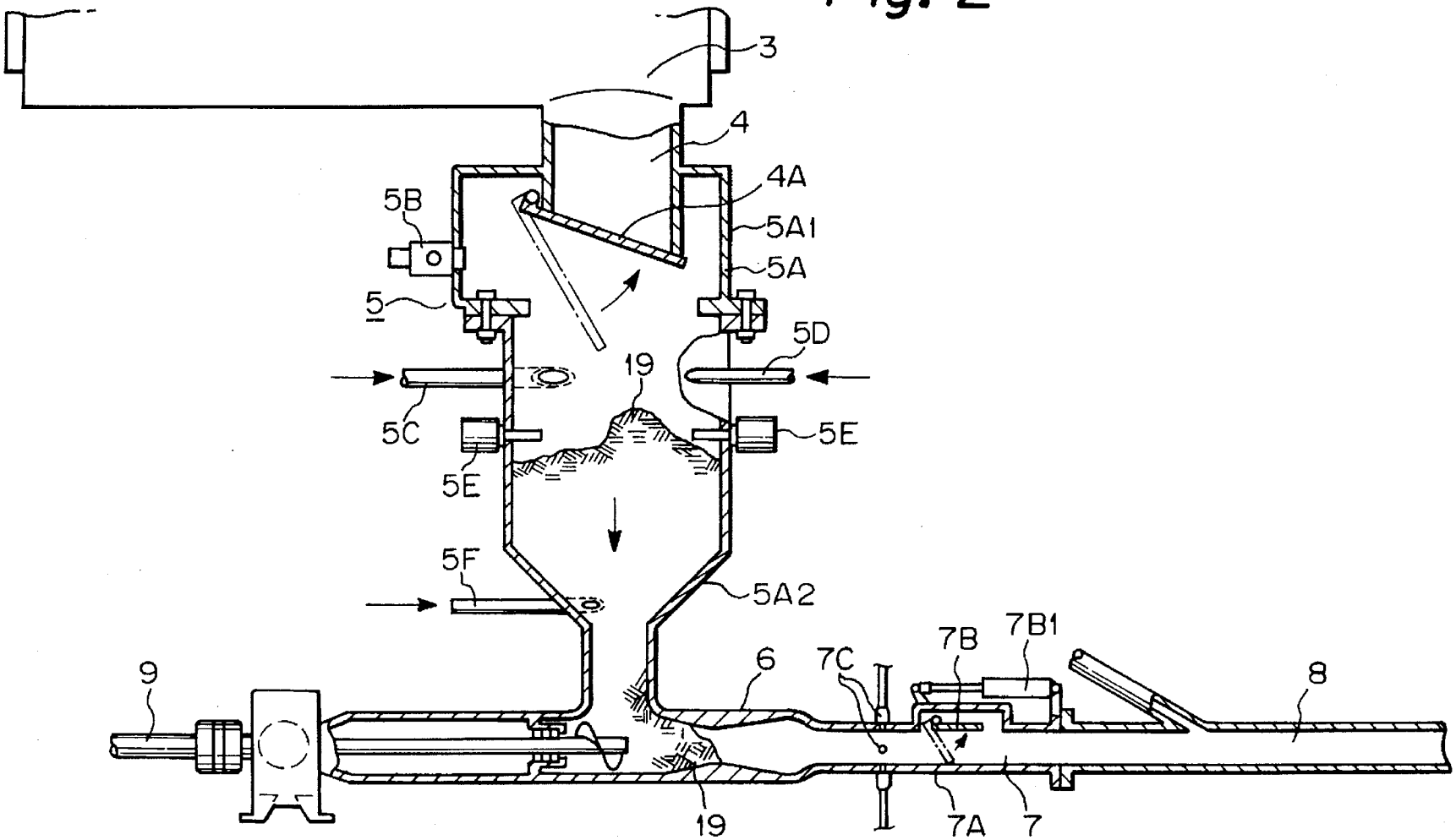
FIGS. 2 to 4 are enlarged cross sections of a portion of the construction including a pressure chamber, showing an operation thereof.
Figure 3:
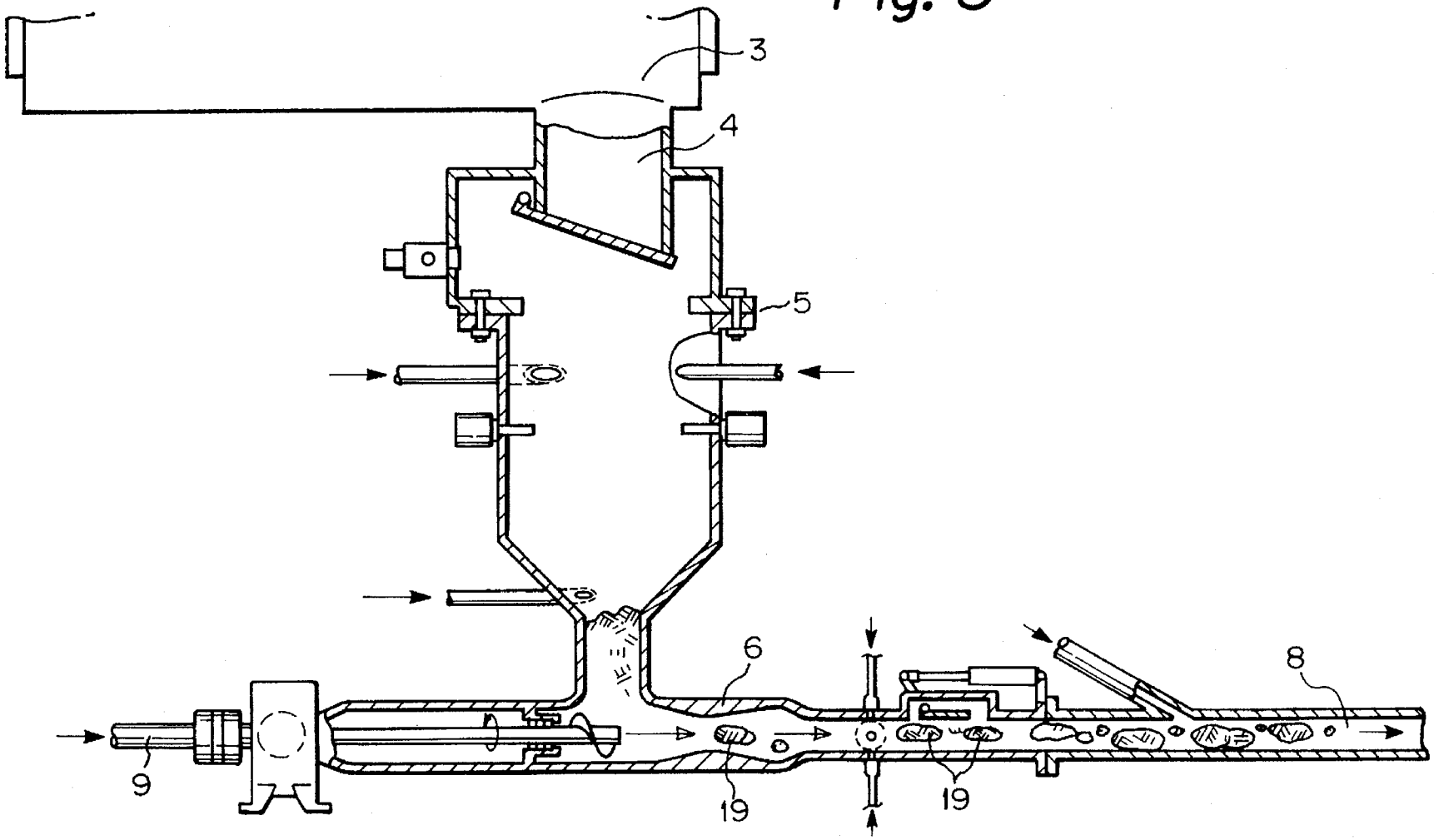
Figure 4:
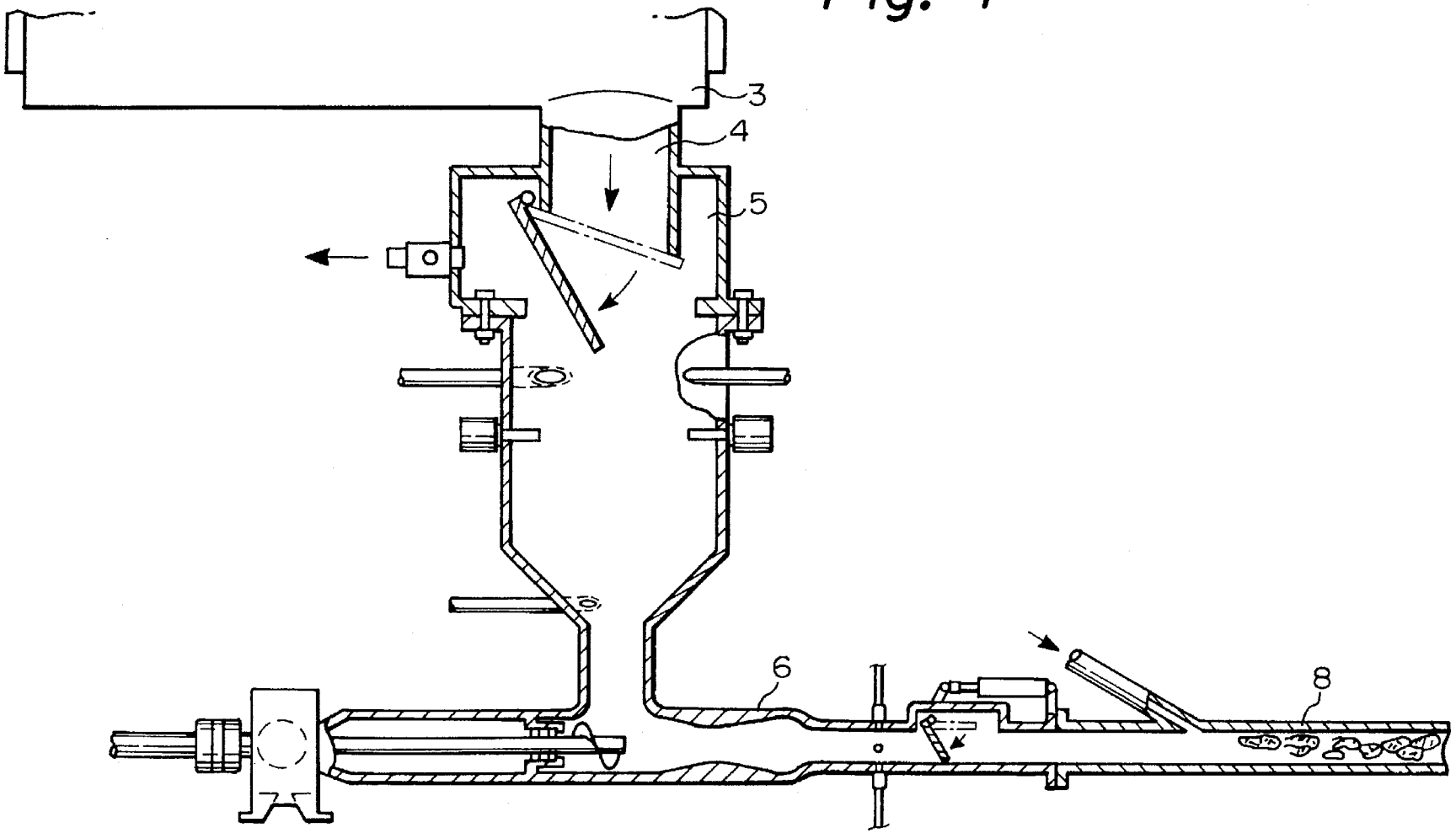

FIG. 1 shows an overall construction of a pneumatic material transporter (1) according to a first embodiment of the present invention, FIGS. 2 to 4 are cross sections for explaining the operation of the pneumatic material transporter (1) and FIG. 5 to 12 show respective components of the pneumatic material transporter (1) in detail.

In FIG. 1, the pneumatic material transporter (1) comprises a material hopper (2) equipped with a screen (not shown), a screw conveyor (3) connected at one end portion to a bottom of the material hopper (2) and extending horizontally, a pressure chamber portion (5) connected to the other end portion of the screw conveyor (3) through a material supply port (4), a horizontal mixer portion (6) connected to a bottom of the pressure chamber portion (5), a material transporting conduit portion (8) connected at one end to the front end portion of the mixer portion (6) through a check valve portion (7) and a compressed air supply pipe (9) connected to a rear end portion of the mixer portion (6).

A material gate (4A) shown in FIGS. 2, 3 and 4 is provided in a lower opening portion of the material supply port (4) and driven by a material gate cylinder (4A1) shown in FIG. 1 to allow the material (19) selectively to pass into the pressure chamber portion (5).

As shown in FIG. 2, the pressure chamber portion (5) comprises a casing (5A) composed of an upper cylinder (5A1) and a lower funnel portion (5A2), a pressure relief valve (5B) provided in an upper portion of a side wall of the upper cylinder portion (5A1), a pressurized air nozzle (5C) connected to a portion of the side wall of the upper cylinder portion (5A1) at a position below the pressure relief valve (5B), a water supply pipe (5D) connected to the side wall of the upper cylinder portion (5A1) in substantially the same level as that of the pressurized air supply nozzle (5C), a pair of material sensors (5E) arranged oppositely in a level below the level of the pressurized air nozzle (5C) and the water supply pipe (5D), for detecting a level of the material (19) in the casing (5A) and an auxiliary pressure nozzle (5F) connected to the side wall of the lower funnel portion (5A2) in a level below the sensors (5E).

The pressure chamber portion (5) functions to stir the material (19) and to send it to the mixer portion (6) under pressure and the pressure relief valve (5B) functions to discharge residual pressurized air in the pressure chamber portion.

The pressurized air nozzle (5C) functions to supply pressurized air to the pressure chamber portion (5) after the material gate (4A) is closed to send the material (19) forcibly to the mixer portion (6) and the sensors (5E) detect the level of the material (19) in the pressure chamber portion (5) and, when the level reaches the level of the sensors (5E), as shown in FIG. 2, produce a signal to stop the material supply to the pressure chamber portion (5). The lower auxiliary pressure nozzle (5F) functions to make a flow of the material (19) from the pressure chamber portion (5) to the mixer portion (6) smooth.

Figure 5:
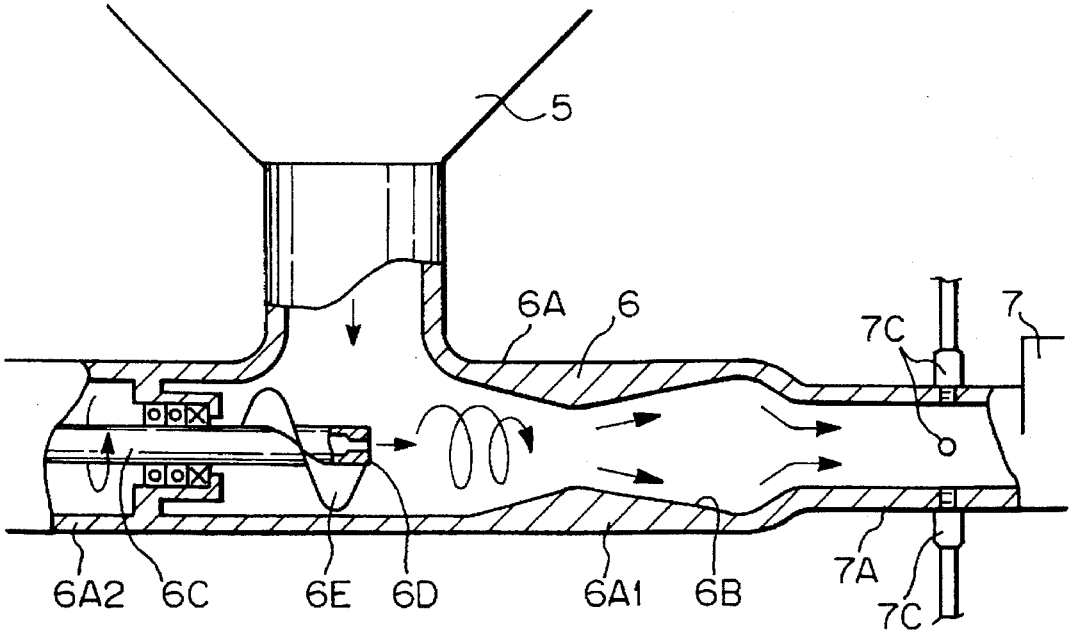
FIG. 5 is an enlarged cross section of a portion of the construction including a mixer portion.

As shown in FIG. 5, the horizontal mixer portion (6) comprises a lateral pipe (6A) connected at substantially a center portion thereof to the bottom of the pressure chamber portion (5), a reducer (6B) formed on an inner wall of a front portion (6A1) of the lateral pipe (6A) and stirring nozzle pipe (6C) coaxially arranged in the lateral pipe (6A) and rotatably supported by a bearing. The stirring nozzle pipe (6C) has a screw fin (6E) on an outer periphery of a front end portion thereof, and a front end of the pipe (6C) has a reduced inner diameter to form a nozzle (6D).

A rear of the stirring nozzle pipe (6C) is connected to a pressurized air supply pipe (9) through a geared motor (6F), a stirring nozzle swivel (6G) and a valve (9A) as shown in FIG. 1.

The mixer portion (6), as indicated in FIG. 3, mixes pressurized air supplied through the pressurized air supply pipe (9) with the material (19) in order to make movement of the materials smooth and the reducer (6B) functions as a joint portion to send the air-material mixture to the pressure conduit (8) which is thinner than the lateral pipe (6A). The stirring nozzle pipe (6C) pushes the material (19) in the lateral pipe (6A) by the screw fin (6E) thereof with an aid of pressurized air jetted from the nozzle (6D) so that there is no residual material in the lateral pipe (6A).

The check valve portion (7) as best shown in FIG. 2, comprises a lateral pipe (7A) having one end connected to the front end of the mixer portion (6) and a check valve (7B) driven by a check valve cylinder (7B1) provided in the lateral pipe (7A).

A plurality (four in the shown embodiment) of water jet nozzles (7C) are provided between the check valve (7B) and the mixer portion (6) to supply water radially and inwardly to an interior of the lateral pipe (7A).

Figure 6:
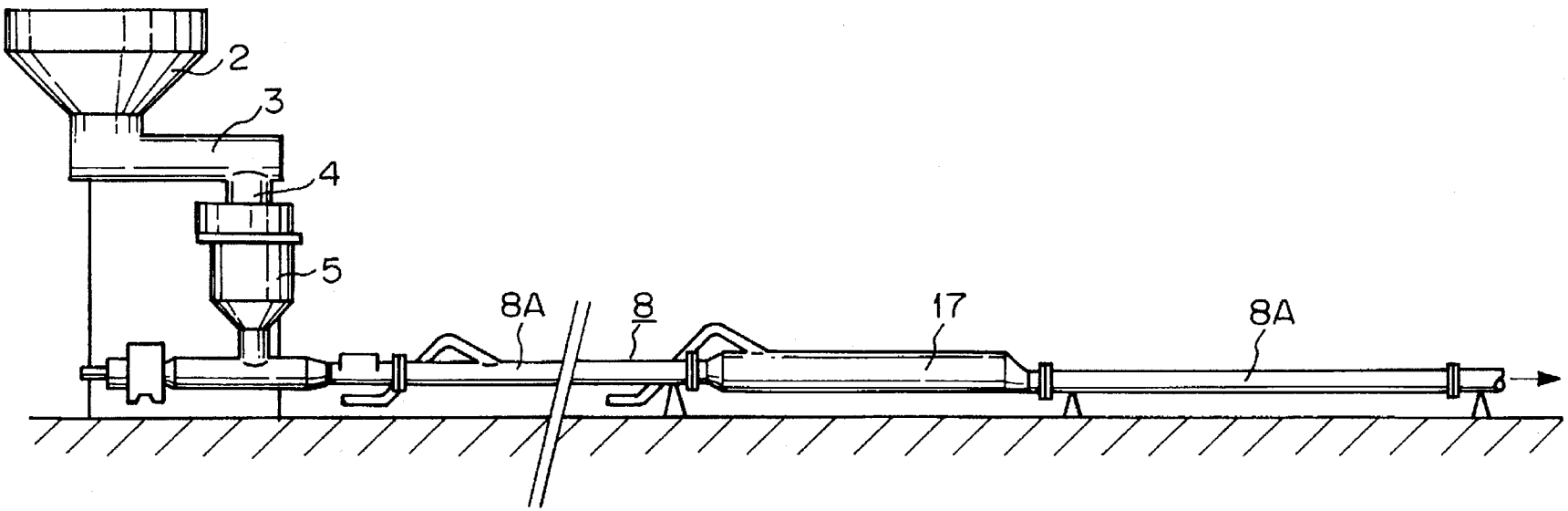
FIG. 6 is an enlarged cross section of a portion of the construction including a material transporting conduit portion.

The transporting conduit portion (8), as shown in FIG. 6, is composed of a plurality of series-connected conduit units (8A) and it extends to a yard.

The check valve (7B) functions to block a backflow of air to thereby prevent a blow back from the material (19).

A second pressurized air supply pipe (10) connected to a pressurized air source through a valve (10B), as shown in FIG. 1, has an end portion (10A) connected obliquely to a rear portion of the conduit unit (8A) and to the check valve portion (7) which is adjacent thereto. The second pressurized air supply pipe (10) always functions to supply pressurized air to the conduit unit (8A) in a direction substantially in parallel to an axis of the conduit unit (8A) such that there is no residual material in the conduit (8), as shown in FIG. 4.

A third pressurized air supply pipe (11) connected to the pressurized air source through a valve (11A), also as shown in FIG. 1, is connected to the upper pressurized air nozzle (5C) and the lower auxiliary nozzle (5F).

An activator supply pipe (13) extending from a bottom of an activator stirring tank (12) and having an activator supply pump (13A), as shown in FIG. 1, is connected to an upper front end portion of the screw conveyor (3), and one end of a water pipe (14) is connected to an upper portion of the activator stirring tank (12) and the other end is connected to a water supply pipe (15) having a first pipe portion (15A) connected to a water source through a water supply pump (15B) and having a second pipe portion (15C) connected to an inlet of a water supply tank (16). The second pipe portion (15C) is also connected to a thin water pipe (15D) which is connected to a portion of the pressurized air supply pipe (9) between the valve (9A) and the swivel (6G).

The activator stirring tank (12) has a stirring fin (12A), driven by a geared motor (12B), and an activator supply port (12C). The activator stirring tank may be provided further with a metering device for measuring an amount of activator in the tank and an activator hopper, if necessary. In the shown embodiment, the metering device is provided to measure a predetermined amount of activator and to supply it to the activator stirring tank (12), although not shown.

The activator supply pump (13A) functions to forcibly supply the activator to the pressure functions portion.

Water is supplied to the activator stirring tank (12) through the water pipe (14).

A lower end of the water supply tank (16) is connected to a pipe (16A) and a pipe (16B). The pipe (16A) is connected to the water supply pipe (5D) of the pressure chamber (5)

and the pipe (16B) is connected to the water jet nozzle (7C) of the check valve portion (7) through a water distributor (16C).

The water jet nozzle (7C) jets water into the material transporting conduit (8) to prevent material from adhering to the inner wall of the conduit.

Figure 10:
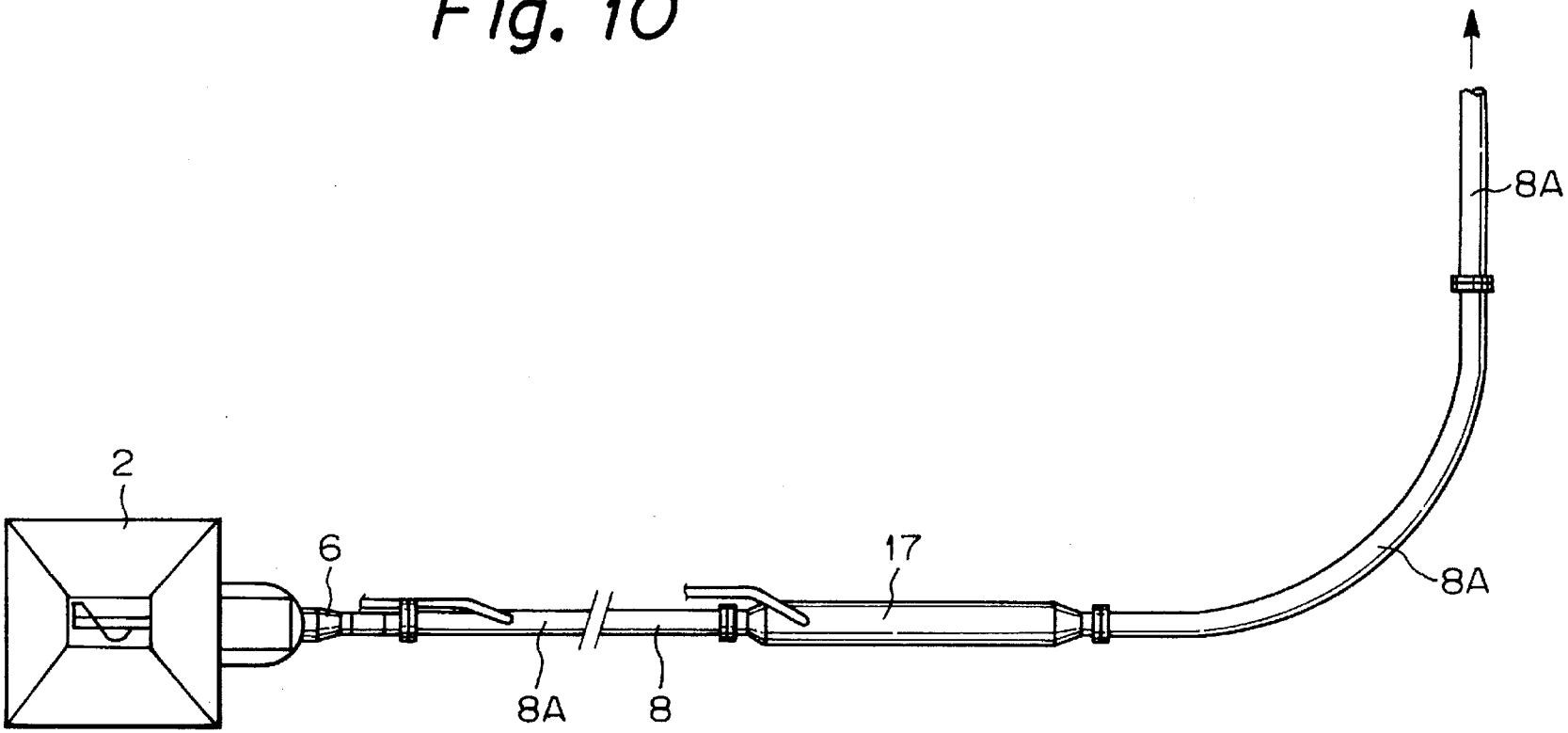
FIG. 10 is a plan view of the portion of the construction including the material transporting conduit portion.
Figure 11:
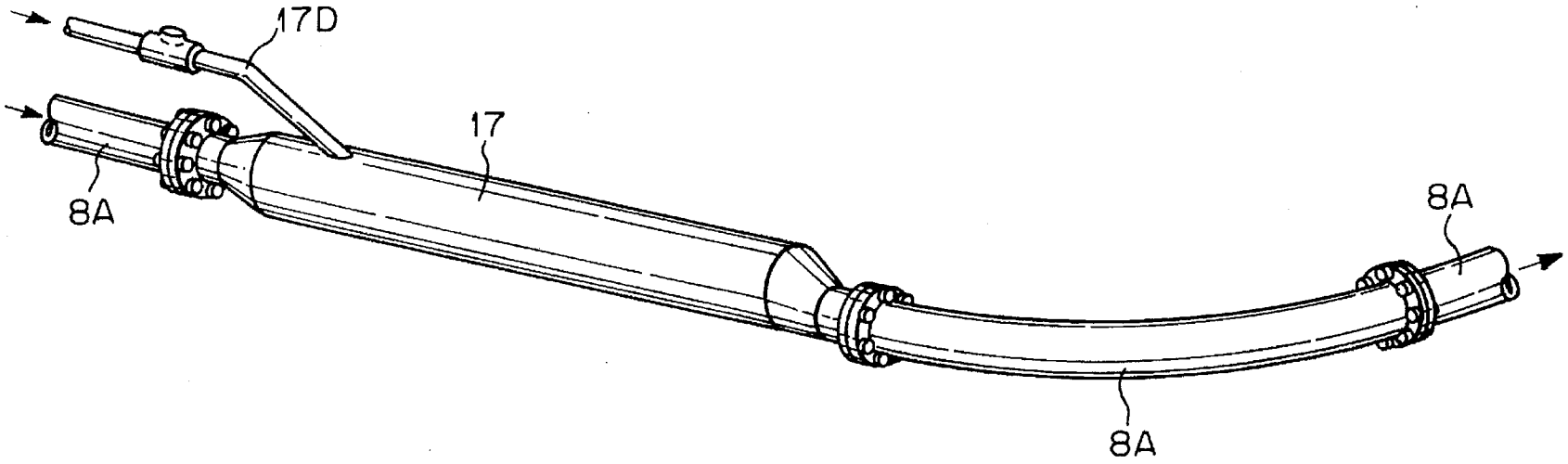
FIG. 11 is an enlarged perspective view of a main portion of the construction shown in FIG. 10.
Figure 12:
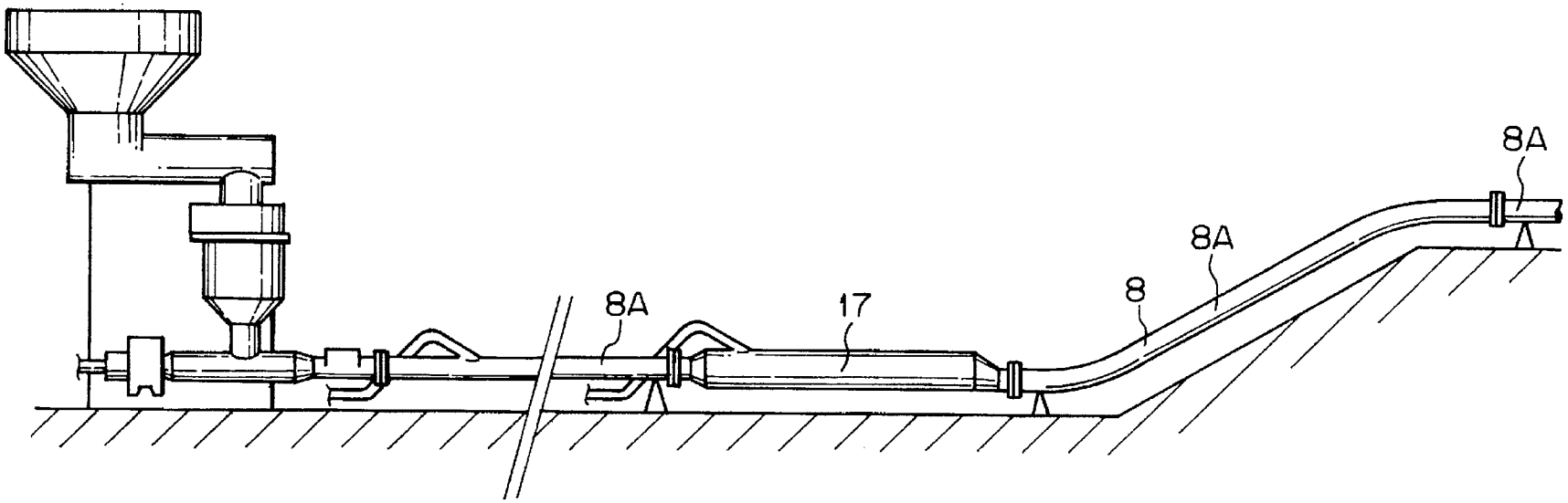
FIG. 12 is a side view of the construction including the material transporting pipe portion.

A first, second and third modifications of the first embodiment will be described with reference to FIGS. 6, 10 and 12, respectively.

The first modification shown in FIG. 6 is featured by the material transporting conduit (8) being composed of a plurality of conduit units (8A) connected in series. The second modification shown in FIG. 10 is featured by that taught in the first modification, and at least one of the series connected conduit units (8A) being curved in a horizontal plane. The third modification shown in FIG. 12 is also featured by that taught in the first modification, and at least one of the conduit units (8A) being slopped upward in a vertical plane.

In these modifications, there is a tendency that the conduit unit, particularly, the curved or slopped conduit unit gets clogged with the materials. In order to prevent such clogging, in each modification a clog-preventing pressure tube (17) must be provided. The clog-preventing pressure tube (17) is disposed between one conduit unit, particularly, the curved or slopped conduit unit (8A) which may be clogged with the material (19), and a conduit unit immediately succeeding thereto.

Figure 7:
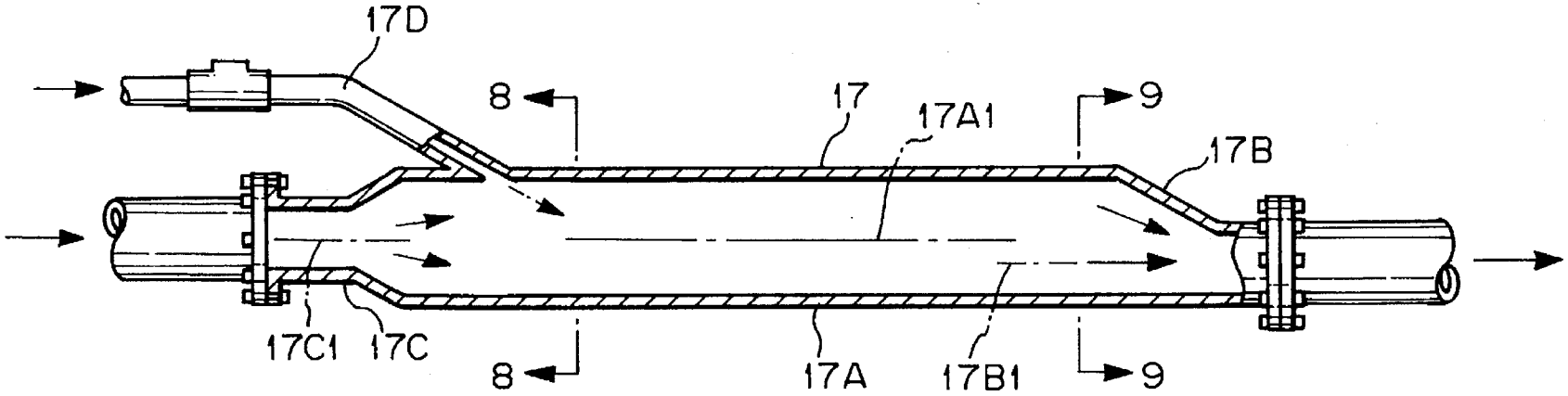
FIG. 7 is an enlarged cross section of a portion of the construction including a clog-preventing portion of the material transporting conduit.
Figure 8:
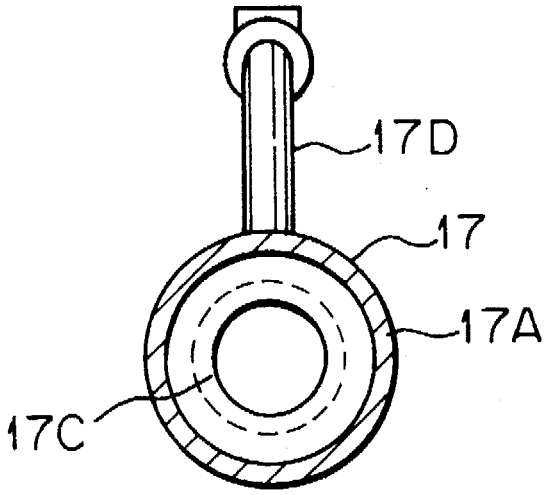
FIG. 8 is a cross section taken along a line 8—8 in FIG. 7.
Figure 9:
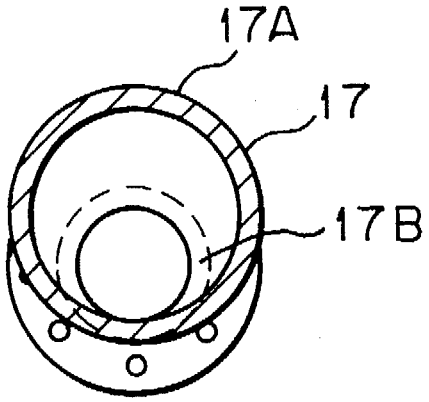
FIG. 9 is a cross section taken along a line 9—9 in FIG. 7.

FIGS. 7 to 9 show the clog-preventing tube (17) in detail. In these figures, the clog-preventing tube (17) includes a rear portion (17C) having an axis (17C1) coaxial with the preceding conduit unit 8A, a middle portion (17A) and a front portion (17B). The rear portion (17C) includes an expanding portion. The middle portion (17A) is coaxial with the rear portion (17C) and has a diameter at least twice the size of the preceding conduit unit (8A) as shown in FIG. 8. The front portion (17B) includes a shrinking portion having a lower wall registered with the middle portion (17A) so that a vertical level of an axis (17B1) of the front portion (17B) is lower than the axis (17A1) of the middle portion (17A) and coincident with the axis of the succeeding conduit unit (8A) as shown in FIG. 9.

Further, as shown in FIG. 7, an intermediate auxiliary air nozzle (17D) connected to the pressure air source is connected to the rear portion (17C) of the clog-preventing tube (17) to jet air therealong in the moving direction of the material (19).

Thus, as indicated above, the operation of the pneumatic material transporter (1), as depicted in FIGS. 2, 3 and 4, will now be described. First, the material (19) is supplied to the material hopper (2). The material is then supplied forcibly to the material supply port (4) by the screw conveyor (3). In supplying the material to the material supply port, an activator is supplied to the screw conveyor from the activator stirring tank (12), if necessary. The activator functions to prevent abrasion of the transporting conduit and to smoothen the transportation.

When the amount of the material in the pressure chamber reaches a predetermined level, as shown in FIG. 2, the material sensors (5E) detect it to stop the screw conveyor and close the gate (4A). Simultaneously therewith, the check valve (7B) is opened to supply compressed air to the pressure chamber through the compressed air nozzle (5C) and the auxiliary nozzle (5F).

A small amount of water is jetted from the injecting nozzle (7C) into the pressure chamber to remove material adhered to the pressure chamber (5) and the transporting conduit (8) to thereby smoothen the pneumatic transportation of the material and prevent dust from scattering from an outlet of the conduit.

As shown by the operation in FIG. 3, the material in the mixer (6) is stirred and pushed by the stirring nozzle (6D). When the material reaches the conduit (8), there is a backflow of compressed air necessarily. Therefore, when the predetermined amount of material is completely transferred from the pressure chamber through the mixer to the conduit, the check valve (7B) is forcibly closed to prevent the backflow of compressed air.

When the material contains large blocks, it is transported through the conduit while the blocks are pushed up by the material push-up means.

When the check valve (7B) is closed, residual compressed air in the pressure chamber is discharged immediately through the relief valve (5B) and the gate (4A) is opened again, as shown in FIG. 4, and the screw conveyor (3) is activated again to allow the next supply of material to go to the pressure chamber.

These operations of the various constitutional components are controlled electrically to smoothen the operation of the pneumatic material transporter and then thereby smoothen the transportation of material. By repeating this operation cycle continuously, a large amount of material can be transported substantially.

The conduit may get clogged with the material transported from the pressure chamber to the conduit under pressure due to friction of the material with the conduit units thereof. This may occur immediately before the material moves from one conduit unit to the next conduit unit.

Therefore, it is preferable to arrange the clog-preventing tube immediately before a transition portion from one conduit unit to the next.

The clog-preventing tube has a diameter which is at least twice the size of the conduit unit to reduce friction of the material temporarily.

With such temporary reduction of friction, abrasion of the transition portion and subsequent friction is reduced, as a result a smooth transportation of the material is going on.

When the transporting conduit is long, the intermediate auxiliary nozzle must be provided in the clog-preventing tube for jetting compressed air therein to restore the pressure lowered by the friction.

A second embodiment of the present invention will now be described with reference to FIG. 13.

Figure 13:
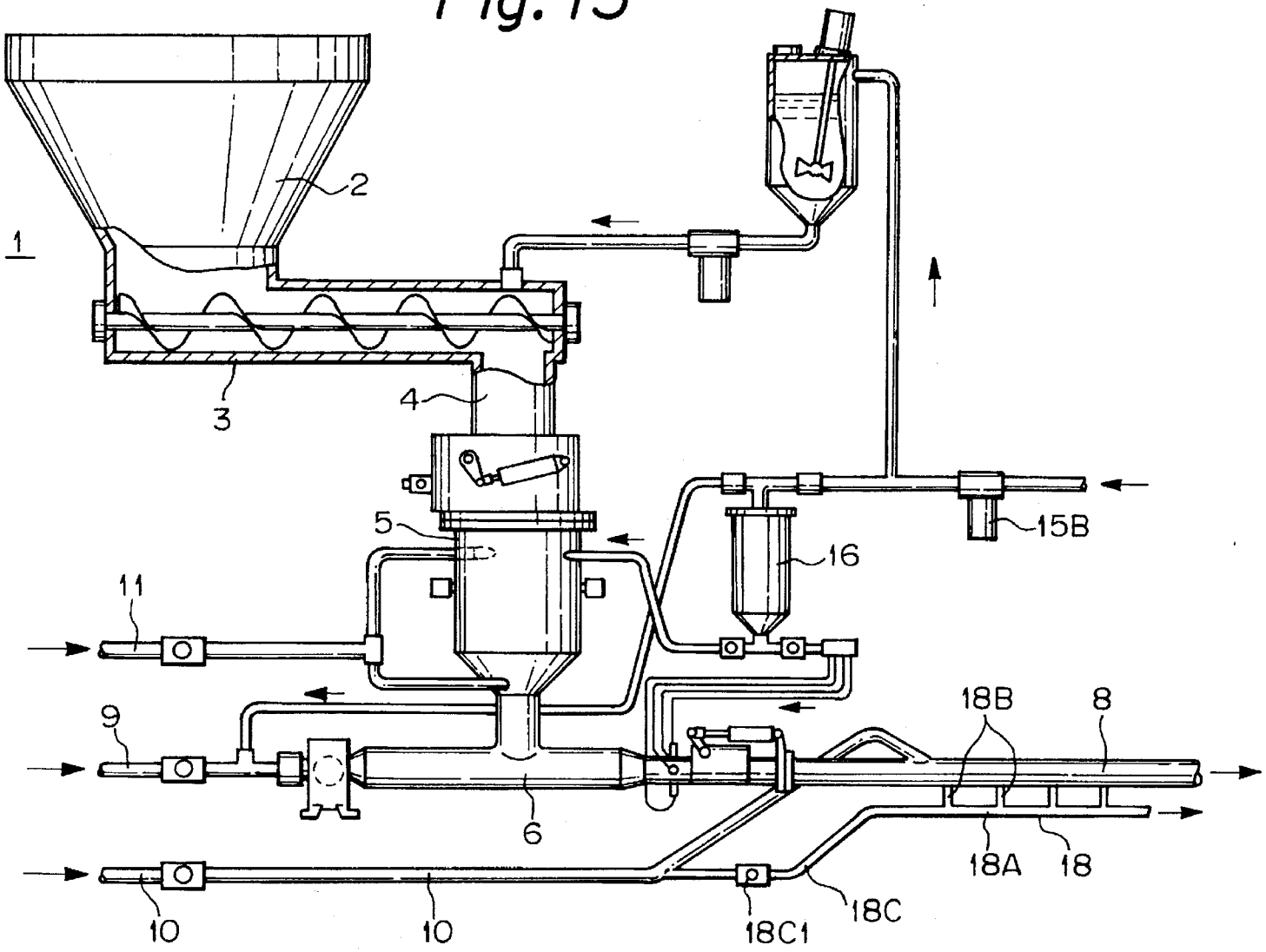
FIG. 13 shows a construction of a pneumatic material transporter according to a second embodiment of the present invention.

In FIG. 13, the pneumatic material transporter (1) comprises a material hopper (2) equipped with a screen (not shown), a screw conveyor (3) connected at one end portion to a bottom of the material hopper (2) and extending horizontally, a pressure chamber portion (5) connected to the other end portion of the screw conveyor (3) through a material supply port (4), a horizontal mixer portion (6) connected to a bottom of the pressure chamber portion (5), a material transporting conduit portion (8) connected at one end to the front end portion of the mixer portion (6) through a check valve portion (7) and a pressurized air supply pipe (9) connected to a rear end portion of the mixer portion (6). This construction shown in FIG. 13 is substantially the same as the first embodiment shown in FIG. 1.

The feature of the second embodiment shown in FIG. 13 with respect to the first embodiment shown in FIG. 1 is that a material push-up device (18) is further provided for assisting a smooth transportation of the material (19) when the latter contains relatively large blocks.

The material push-up device (18) includes a lateral pipe portion (18A) connected to the secondary pressure air supply pipe (10) through a pipe portion (18C) and a valve (18C1). A far end (not shown) of the lateral pipe portion (18A) is closed. The lateral pipe portion (18A) is provided in an upper wall thereof with a plurality of holes which are connected to a lower wall of the material transporting conduit portion (8) through air supply pipes (18B).

When the material (19) contains a large amount of blocks, the air is jetted upward from the lateral pipe portion (18A) to the interior of the pressure transporting conduit portion (8) to float the materials within the conduit portion (8) to thereby smooth the flow of the materials.

Figure 14:
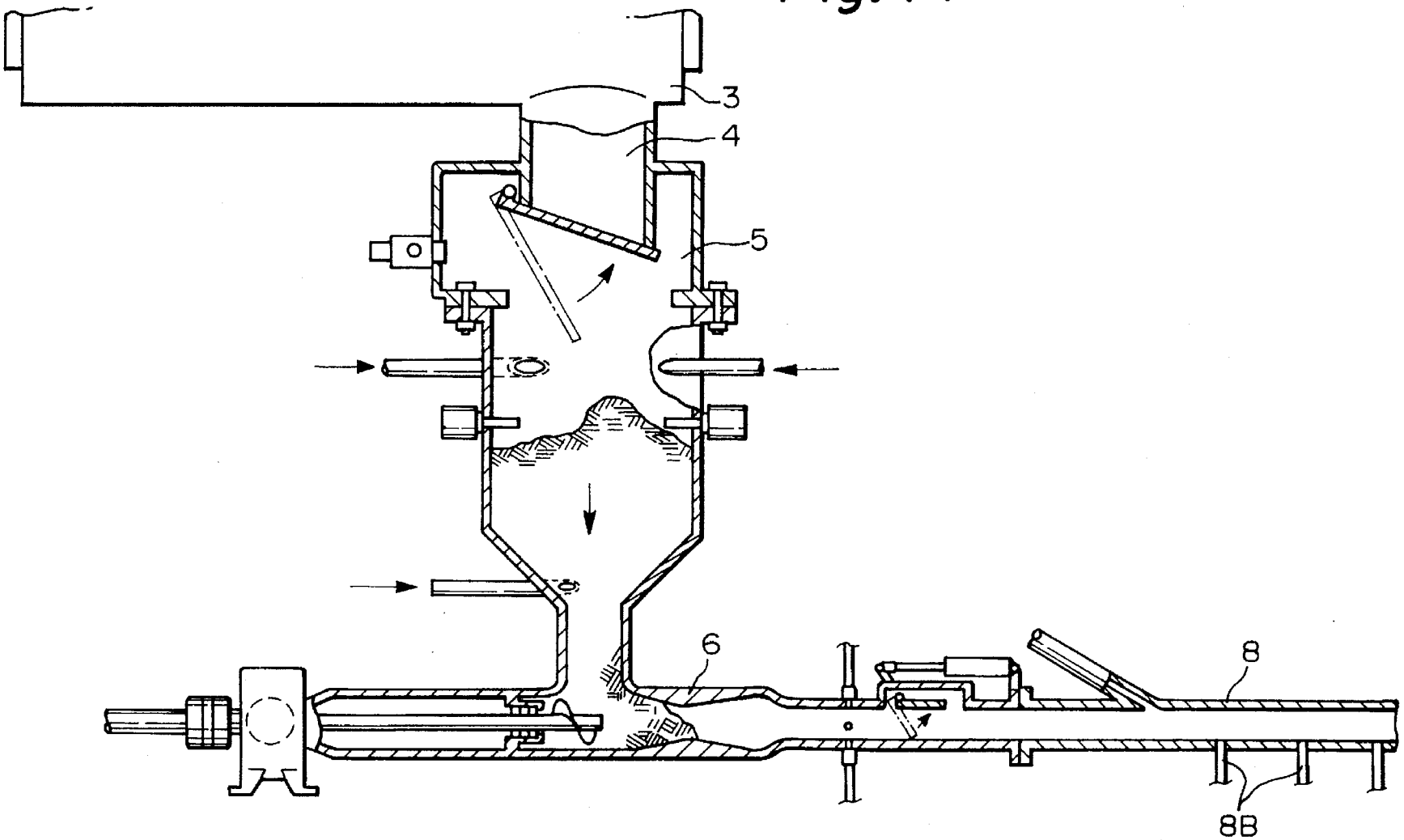
FIGS. 14 to 16 are enlarged cross sections of a portion of the construction of the second embodiment including a material transporting device, showing an operation thereof.
Figure 15:
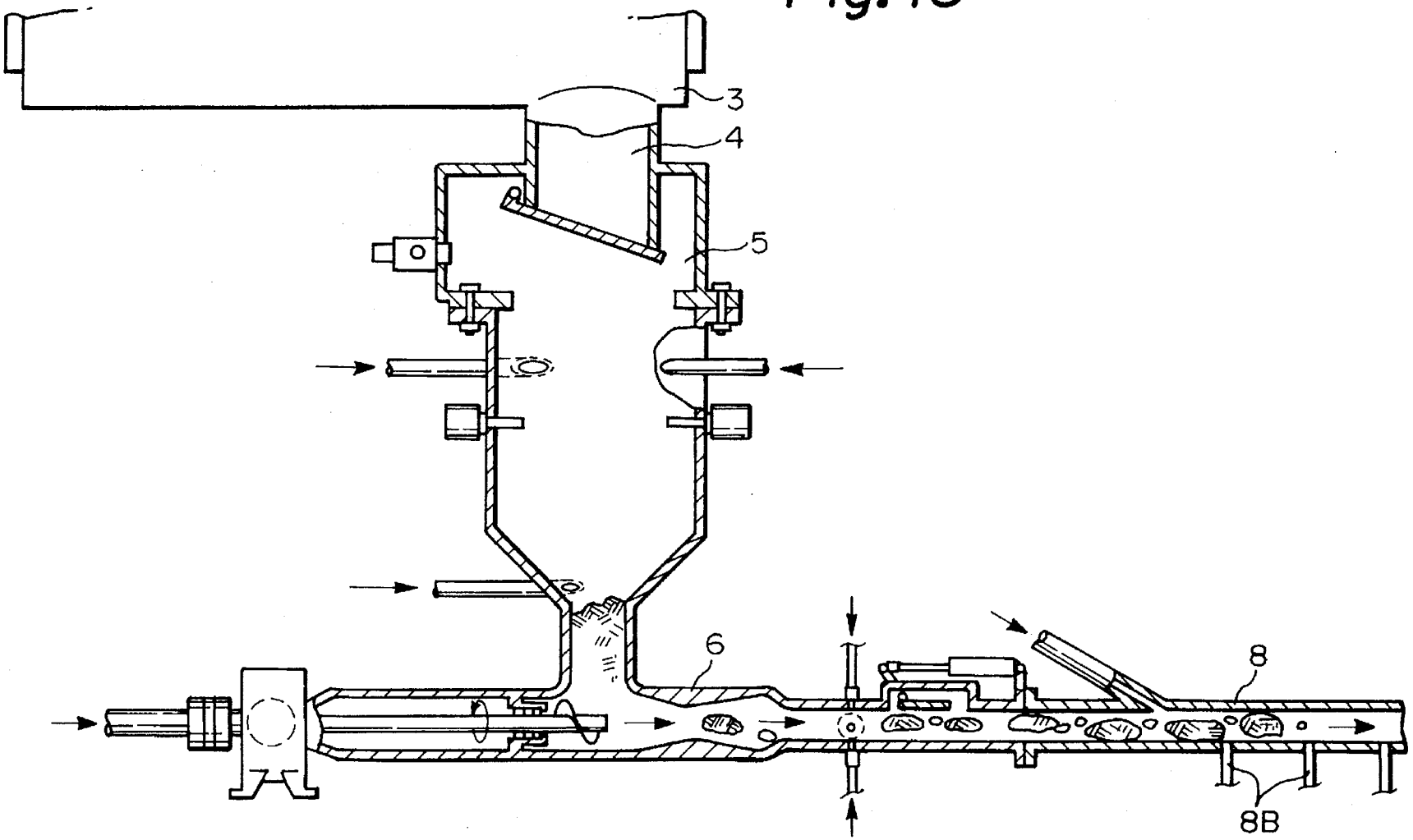
Figure 16:
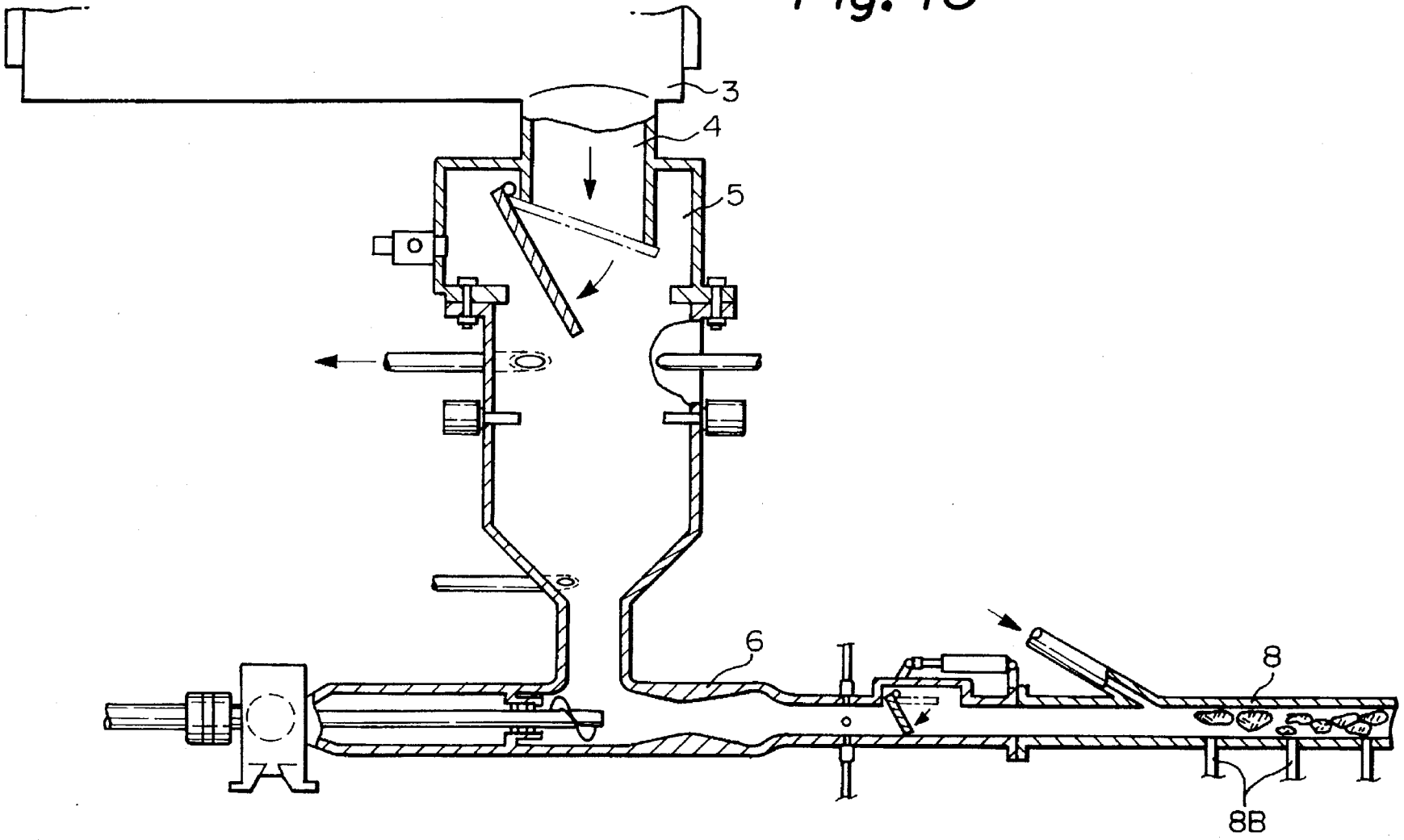

It is noted, that with the exception of the air supply pipes (18B), the showings in FIGS. 2, 3 and 4 are substantially the same as the showings in FIGS. 14, 15 and 16, respectively. Accordingly, it is obvious that the operations depicted in FIGS. 2, 3 and 4, as described above, are therefore substantially the same as the operations depicted in FIGS. 14, 15 and 16, respectively. Thus, it is not thought necessary to repeat these operations here again for an understanding of the operations depicted in FIGS. 14, 15 and 16.

As described above in detail, the pneumatic material transporter according to the present invention is simple in structure, compact and light weight, so that the installation thereof can be done easily, even manually, and even on soft ground. Since it is necessary to arrange the materials transporting conduit units, there is no need of preliminary construction of a temporary road to transport the waste materials. Further, since the waste materials are transported through the conduit, there is no problem of a traffic accident, noise and public pollution such as exhausting gases. In addition, there is no pressure tank required. Since there is no need to use a large amount of water, the post-treatment of the transported material is substantially unnecessary.

What is claimed is:

1. An air transporter comprising:

a material hopper to store material supplied thereto;

a screw conveyor having a rear portion connected to a lower end opening of said material hopper, said screw conveyor including means for transporting the material (supplied from said hopper) from said rear portion to a front portion of said screw conveyor;

a pressure chamber portion having an upper opening connected to said front portion of said screw conveyor through a material port, said pressure chamber portion including pressure means to press the material (supplied from said material port) down while adding a limited amount of water;

a horizontal mixer having a front portion, an intermediate portion connected to a lower opening of said pressure chamber portion and a rear portion connected to a compressed air supply pipe, said horizontal mixer mixing the material (supplied from said pressure chamber portion) with pressurized air (supplied through said compressed air supply pipe) and then pushing the material toward said front portion of said horizontal mixer;

a material transporting conduit portion connected to said front portion of said horizontal mixer through a check valve portion to transport the material to a yard;

an openable material gate being provided in said material port; and sensor means provided in said pressure chamber portion for closing said openable material gate when the material in said pressure chamber portion reaches a predetermined level.

2. An air transporter according to claim 1, wherein said pressure chamber portion includes relief valve means to discharge residual compressed air from said pressure chamber portion for opening said openable material gate.

3. An air transporter comprising:

a material hopper to store material supplied thereto;

a screw conveyor having a rear portion connected to a lower end opening of said material hopper, said screw conveyor including means for transporting the material (supplied from said hopper) from said rear portion to a front portion of said screw conveyor;

a pressure chamber portion having an upper opening connected to said front portion of said screw conveyor through a material port, said pressure chamber portion including pressure means to press the material (supplied from said material port) down while adding a limited amount of water;

a horizontal mixer having a front portion, an intermediate portion connected to a lower opening of said pressure chamber portion and a rear portion connected to a compressed air supply pipe, said horizontal mixer mixing the material (supplied from said pressure chamber portion) with pressurized air (supplied through said compressed air supply pipe) and then pushing the material toward said front portion of said horizontal mixer;

a material transporting conduit portion connected to said front portion of said horizontal mixer through a check valve portion to transport the material to a yard;

said pressure chamber portion including a casing having an upper cylinder portion and a lower funnel portion; and pressure relief valve means provided in a side wall of said upper cylinder portion to discharge residual compressed air from said pressure chamber portion.

4. An air transporter according to claim 3, wherein said pressure means includes a pressurized air nozzle provided on said side wall of said upper cylinder portion, and a water supply pipe also provided on said side wall of said upper cylinder portion.

5. An air transporter according to claim 4, wherein said pressure chamber portion includes material sensor means provided on said side wall of said upper cylinder portion at a level below said pressurized air nozzle and said water supply pipe to detect when the material in said pressure chamber portion reaches a predetermined level.

6. An air transporter according to claim 5, wherein an auxiliary pressurized air nozzle is provided on a side wall of said lower funnel portion at a level below said material sensor means.

7. An air transporter according to claim 6, wherein said pressurized air nozzle and said auxiliary pressurized air nozzle are connected to a primary pressurized air supply pipe.

8. An air transporter comprising:

a material hopper to store material supplied thereto;

a screw conveyor having a rear portion connected to a lower end opening of said material hopper, said screw conveyor including means for transporting the material (supplied from said hopper) from said rear portion to a front portion of said screw conveyor;

a pressure chamber portion having an upper opening connected to said front portion of said screw conveyor through a material port, said pressure chamber portion including pressure means to press the material (supplied from said material port) down while adding a limited amount of water;

a horizontal mixer having a front portion, an intermediate portion connected to a lower opening of said pressure chamber portion and a rear portion connected to a compressed air supply pipe, said horizontal mixer mixing the material (supplied from said pressure chamber portion) with pressurized air (supplied through said compressed air supply pipe) and then pushing the material toward said front portion of said horizontal mixer;

a material transporting conduit portion connected to said front portion of said horizontal mixer through a check valve portion to transport the material to a yard; and activator means for supplying an activator to said screw conveyor, said activator means including an activator stirring tank for receiving a predetermined amount of the activator, an activator injecting pipe having one end connected to a lower opening of said activator stirring tank through an activator injecting pump, and the other end of said activator injecting pipe being connected to said front portion of said screw conveyor.

9. An air transporter according to claim 8, wherein a water supply pipe has one end connected to an upper portion of said activator stirring tank, the other end of said water supply pipe being connected to a water supply pump, and a water supply tank having an inlet connected to said water supply pump.

10. An air transporter comprising:

a material hopper to store material supplied thereto;

a screw conveyor having a rear portion connected to a lower end opening of said material hopper, said screw conveyor including means for transporting the material (supplied from said hopper) from said rear portion to a front portion of said screw conveyor;

a pressure chamber portion having an upper opening connected to said front portion of said screw conveyor through a material port, said pressure chamber portion including pressure means to press the material (supplied from said material port) down while adding a limited amount of water;

a horizontal mixer having a front portion, an intermediate portion connected to a lower opening of said pressure chamber portion and a rear portion connected to a compressed air supply pipe, said horizontal mixer mixing the material (supplied from said pressure chamber portion) with pressurized air (supplied through said compressed air supply pipe) and then pushing the material toward said front portion of said horizontal mixer;

a material transporting conduit portion connected to said front portion of said horizontal mixer through a check valve portion to transport the material to a yard;

said front portion of said horizontal mixer including a reducer provided by a reduced inner wall thereof;

said rear portion of said horizontal mixer including a rotatably supported stirring nozzle pipe having a rear end connected to said compressed air supply pipe through a geared motor, a swivel and a valve; and said rear end of said stirring nozzle pipe also being connected to an inlet of a water supply tank at a position between said valve and said swivel.

11. An air transporter according to claim 10, wherein a stirring nozzle is provided in a front end face of said stirring nozzle pipe, and a stirring fin is provided on a peripheral surface of a front end portion of said stirring nozzle pipe, said stirring fin being positioned in an area facing towards said lower opening of said pressure chamber portion.

12. An air transporter according to claim 10, wherein said check valve portion includes a lateral pipe having a rear end connected to said front portion of said horizontal mixer, a check valve is provided in said lateral pipe, said check valve being driven by a check valve cylinder, and a plurality of water supply nozzles are provided between said front portion of said horizontal mixer and said check valve for injecting water radially inwardly of said lateral pipe.

13. An air transporter according to claim 10, wherein said inlet of said water supply tank is connected to a water supply pump and to a portion of said compressed air supply pipe positioned between said valve and said swivel, and an output of said water supply tank is connected to a water supply pipe of said pressure chamber portion and to a water injecting nozzle of said check valve portion through a water injecting distributor.

14. An air transporter comprising:

a material hopper to store material supplied thereto;

a screw conveyor having a rear portion connected to a lower end opening of said material hopper, said screw conveyor including means for transporting the material (supplied from said hopper) from said rear portion to a front portion of said screw conveyor;

a pressure chamber portion having an upper opening connected to said front portion of said screw conveyor through a material port, said pressure chamber portion including pressure means to press the material (supplied from said material port) down while adding a limited amount of water;

a horizontal mixer having a front portion, an intermediate portion connected to a lower opening of said pressure chamber portion and a rear portion connected to a compressed air supply pipe, said horizontal mixer mixing the material (supplied from said pressure chamber portion) with pressurized air (supplied through said compressed air supply pipe) and then pushing the material toward said front portion of said horizontal mixer;

a material transporting conduit portion connected to said front portion of said horizontal mixer through a check valve portion to transport the material to a yard;

said material transporting conduit portion including a plurality of pressure conduit units connected together in a series arrangement, one conduit unit of said conduit units being disposed adjacent to said check valve portion, said one conduit unit having a hole to receive an end of a pressurized air supply pipe extending obliquely with respect to said check valve portion and said one conduit unit, said pressurized air supply pipe being connected to a pressurized air supply tube for injecting pressurized air into said one conduit unit in a direction substantially parallel with an axis of said one conduit unit.

15. An air transporter according to claim 14, wherein said conduit units include a first conduit unit disposed adjacent to a second conduit unit, said material transporting conduit portion including at least one clog-preventing tube, said one clog-preventing tube being disposed between said first and second conduit units, said one clog-preventing tube including a rear tube portion provided with an inlet tube portion connected to said first conduit unit, an expanding tube portion of said one clog-preventing tube connecting a rear end of an intermediate tube portion of said one clog-preventing tube to said inlet tube portion, said intermediate tube portion having an axis registered with an axis of said first conduit unit, a front end of said intermediate tube portion being connected to a shrinking tube portion of said one clog-preventing tube, said shrinking tube portion having a front end tube portion connected to said second conduit unit, said front end tube portion having an axis disposed below said axis of said intermediate tube portion.

16. An air transporter according to claim 15, wherein said rear end of said intermediate tube portion is provided with a hole for receiving an obliquely extending intermediate auxiliary nozzle connected to said pressurized air supply tube for injecting pressurized air into said intermediate tube portion to assist in a smooth transportation of the material.

17. An air transporter according to claim 14, wherein said material transporting conduit portion includes material push-up means for pushing the material therein up to assist in a smooth transportation of the material therethrough.

18. An air transporter according to claim 16, wherein said material push-up means includes a lateral pipe portion having one end connected to said pressurized air supply tube through a valve, said lateral pipe portion being connected to a bottom of at least one of said conduit units through a plurality of pipes so that the material therein is pushed up by pressurized air which is supplied through said pipes of said lateral pipe portion.

* * * * *